US010000066B2

(12) United States Patent
Nakai

(10) Patent No.: US 10,000,066 B2
(45) Date of Patent: Jun. 19, 2018

(54) LIQUID DISCHARGE HEAD, LIQUID DISCHARGE DEVICE, AND LIQUID DISCHARGE APPARATUS

(71) Applicant: Takayuki Nakai, Kanagawa (JP)

(72) Inventor: Takayuki Nakai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/428,172

(22) Filed: Feb. 9, 2017

(65) Prior Publication Data

US 2017/0225485 A1 Aug. 10, 2017

(30) Foreign Application Priority Data

Feb. 10, 2016 (JP) ..... 2016-023362
Dec. 8, 2016 (JP) ..... 2016-238072

(51) Int. Cl.
*B41J 2/18* (2006.01)
*B41J 2/175* (2006.01)

(52) U.S. Cl.
CPC ..... *B41J 2/18* (2013.01); *B41J 2/175* (2013.01); *B41J 2/17506* (2013.01)

(58) Field of Classification Search
CPC ..... B41J 2/18
See application file for complete search history.

(56) References Cited

U.S. PATENT DOCUMENTS

2010/0091055 A1* 4/2010 Kawakami ..... B41J 2/175 347/9
2015/0306875 A1* 10/2015 Nishimura ..... B41J 2/1433 347/71
2016/0082728 A1 3/2016 Kohda et al.
2016/0096369 A1 4/2016 Shimizu et al.
2016/0185113 A1 6/2016 Yoshida et al.

FOREIGN PATENT DOCUMENTS

JP 2006-198952 8/2006

* cited by examiner

*Primary Examiner* — Bradley Thies
(74) *Attorney, Agent, or Firm* — Cooper & Dunham LLP

(57) ABSTRACT

A liquid discharge head includes a nozzle, an individual liquid chamber, a common liquid chamber, a fluid restrictor, a circulation channel, a circulation fluid restrictor, and a plurality of laminated plate members. The nozzle discharges liquid. The individual liquid chamber is communicated with the nozzle. The common liquid chamber supplies the liquid to the individual liquid chamber. The fluid restrictor is disposed between the individual liquid chamber and the common liquid chamber. The circulation channel is communicated with the individual liquid chamber. The circulation fluid restrictor is disposed between the individual liquid chamber and the circulation channel. The plurality of laminated plate members constitutes the fluid restrictor, the individual liquid chamber, and the circulation fluid restrictor. A single plate member of the plurality of laminated plate members defines a fluid resistance value of the fluid restrictor and a fluid resistance value of the circulation fluid restrictor.

20 Claims, 13 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2016-023362 filed on Feb. 10, 2016 and 2016-238072 filed on Dec. 8, 2016 in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

A discharge head (droplet discharge head) to discharge liquid has, for example, a configuration of supplying liquid from a common liquid chamber or a liquid introduction portion communicated with the common liquid chamber to an individual liquid chamber via a fluid restrictor, to, for example, enhance the efficiency in pressurizing liquid in the individual liquid chamber.

Conventionally, for example, a plurality of plate members may be laminated one on another to form individual liquid chambers and fluid restrictors.

SUMMARY

In an aspect of the present disclosure, there is provided a liquid discharge head that includes a nozzle, an individual liquid chamber, a common liquid chamber, a fluid restrictor, a circulation channel, a circulation fluid restrictor, and a plurality of laminated plate members. The nozzle discharges liquid. The individual liquid chamber is communicated with the nozzle. The common liquid chamber supplies the liquid to the individual liquid chamber. The fluid restrictor is disposed between the individual liquid chamber and the common liquid chamber. The circulation channel is communicated with the individual liquid chamber. The circulation fluid restrictor is disposed between the individual liquid chamber and the circulation channel. The plurality of laminated plate members constitutes the fluid restrictor, the individual liquid chamber, and the circulation fluid restrictor. A single plate member of the plurality of laminated plate members defines a fluid resistance value of the fluid restrictor and a fluid resistance value of the circulation fluid restrictor.

In another aspect of the present disclosure, there is provided a liquid discharge head that includes a nozzle, an individual liquid chamber, a common liquid chamber, a fluid restrictor, a circulation channel, a circulation fluid restrictor, and a plurality of laminated plate members. The nozzle discharges liquid. The individual liquid chamber is communicated with the nozzle. The common liquid chamber supplies the liquid to the individual liquid chamber. The fluid restrictor is disposed between the individual liquid chamber and the common liquid chamber. The circulation channel is communicated with the individual liquid chamber. The circulation fluid restrictor is disposed between the individual liquid chamber and the circulation channel. The plurality of laminated plate members constitutes the fluid restrictor, the individual liquid chamber, and the circulation fluid restrictor. The single plate member of the plurality of laminated plate members is disposed between the fluid restrictor and the circulation fluid restrictor. The single plate member includes a plurality of recessed portions at a first surface of the single plate member opposing the fluid restrictor and a second surface of the single plate member opposing the circulation fluid restrictor. One of the plurality of recessed portions at the first surface of the single plate member is disposed adjacent to the fluid restrictor. Another of the plurality of recessed portions at the second surface of the single plate member is disposed adjacent to the circulation fluid restrictor.

In still another aspect of the present disclosure, there is provided a liquid discharge device that includes the liquid discharge head according to any of the aspects of the present disclosure, to discharge liquid.

In still yet another aspect of the present disclosure, there is provided a liquid discharge apparatus that includes the liquid discharge device to discharge the liquid.

In still yet another aspect of the present disclosure, there is provided a liquid discharge apparatus including the liquid discharge head according to any of the aspects of the present disclosure, to discharge the liquid.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
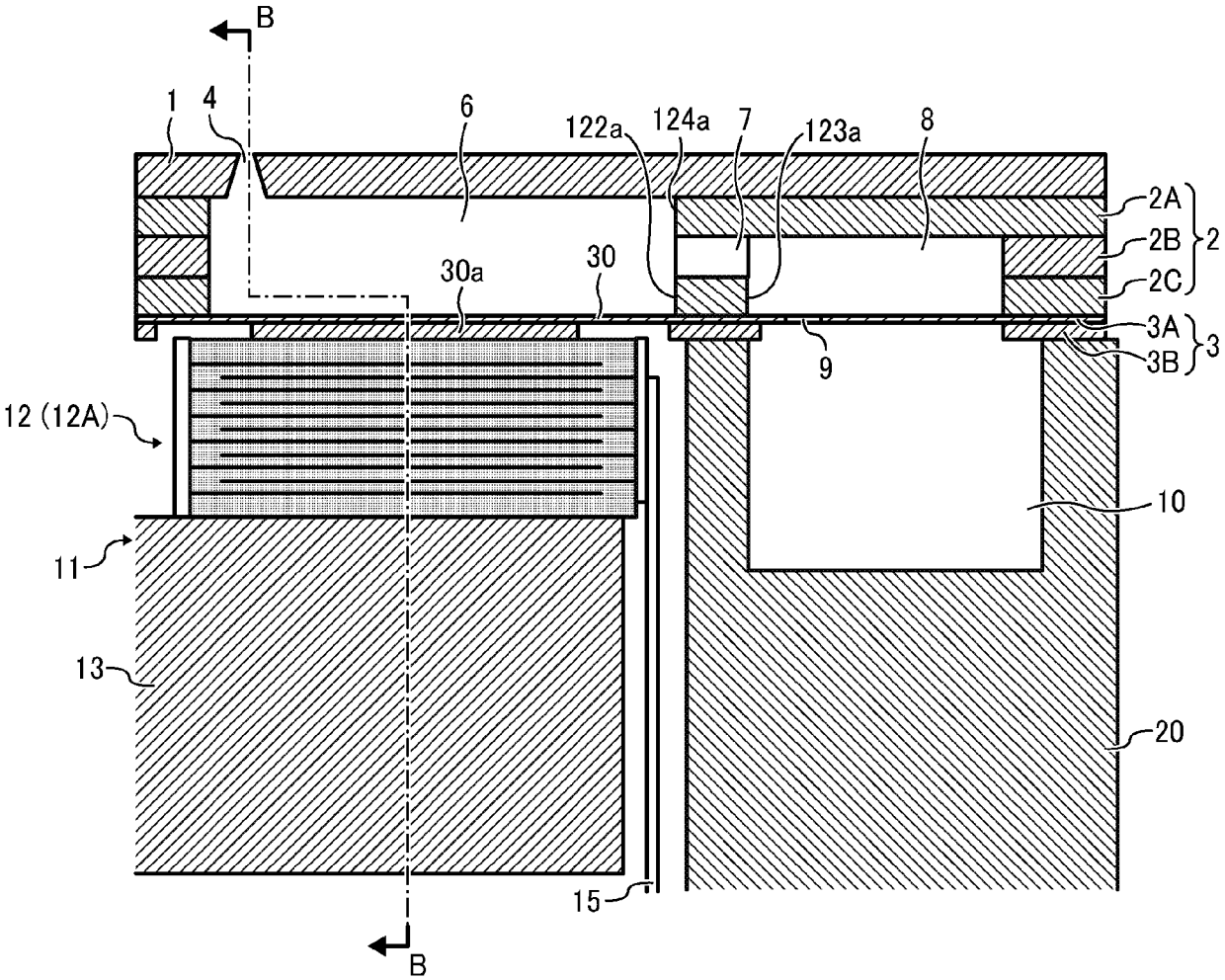
FIG. 1 is a cross-sectional view of a liquid discharge head according to an embodiment of the present disclosure, cut along line A-A of FIG. 3 in a direction (a longitudinal direction of an individual liquid chamber) perpendicular to a nozzle array direction in which nozzles are arrayed in row.

The accompanying drawings are intended to depict embodiments of the present disclosure and should not be interpreted to limit the scope thereof The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
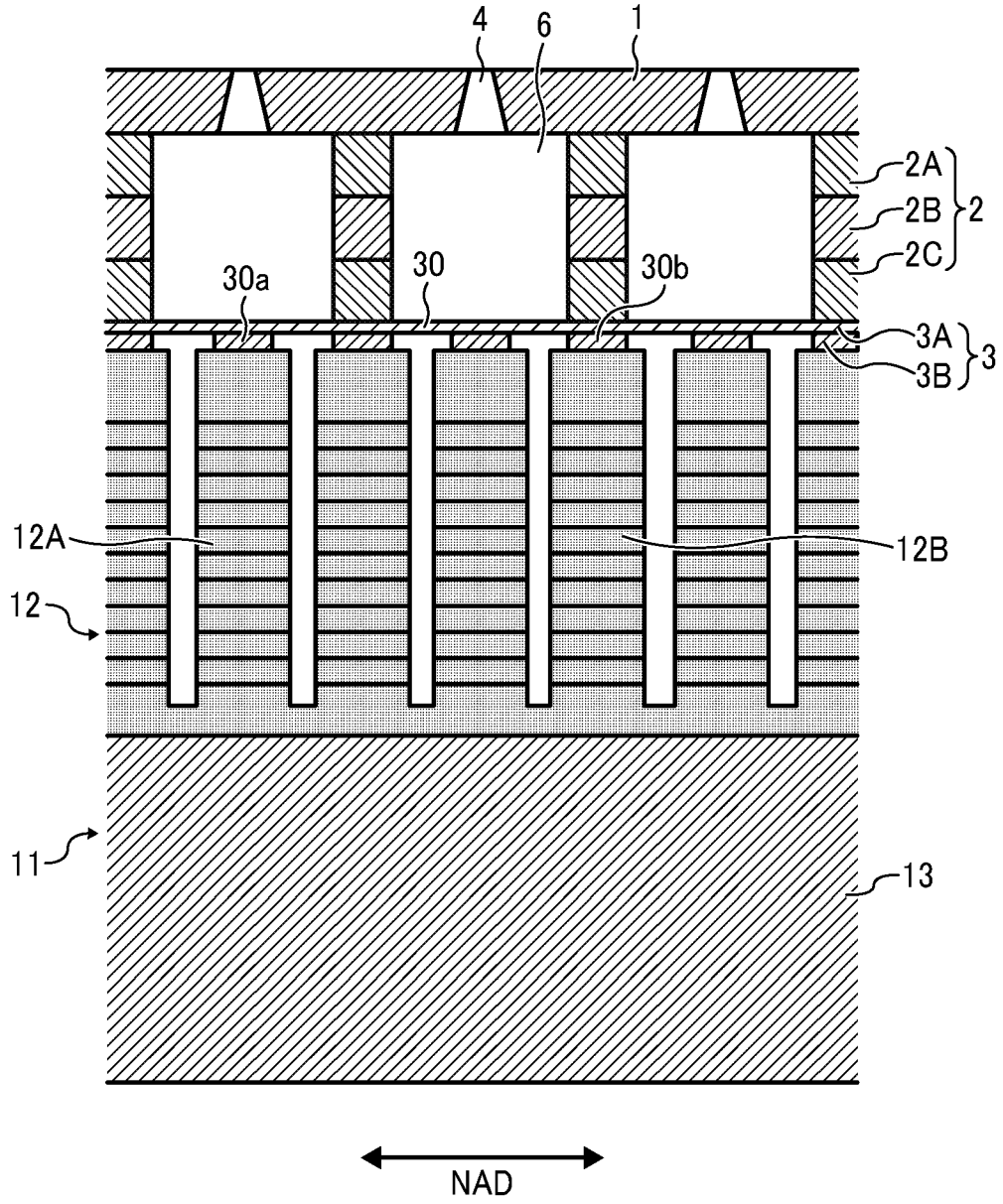
FIG. 2 is a cross-sectional view of the liquid discharge head cut along line B-B of FIG. 1 in the nozzle array direction (a liquid-chamber transverse direction)
Figure 3:
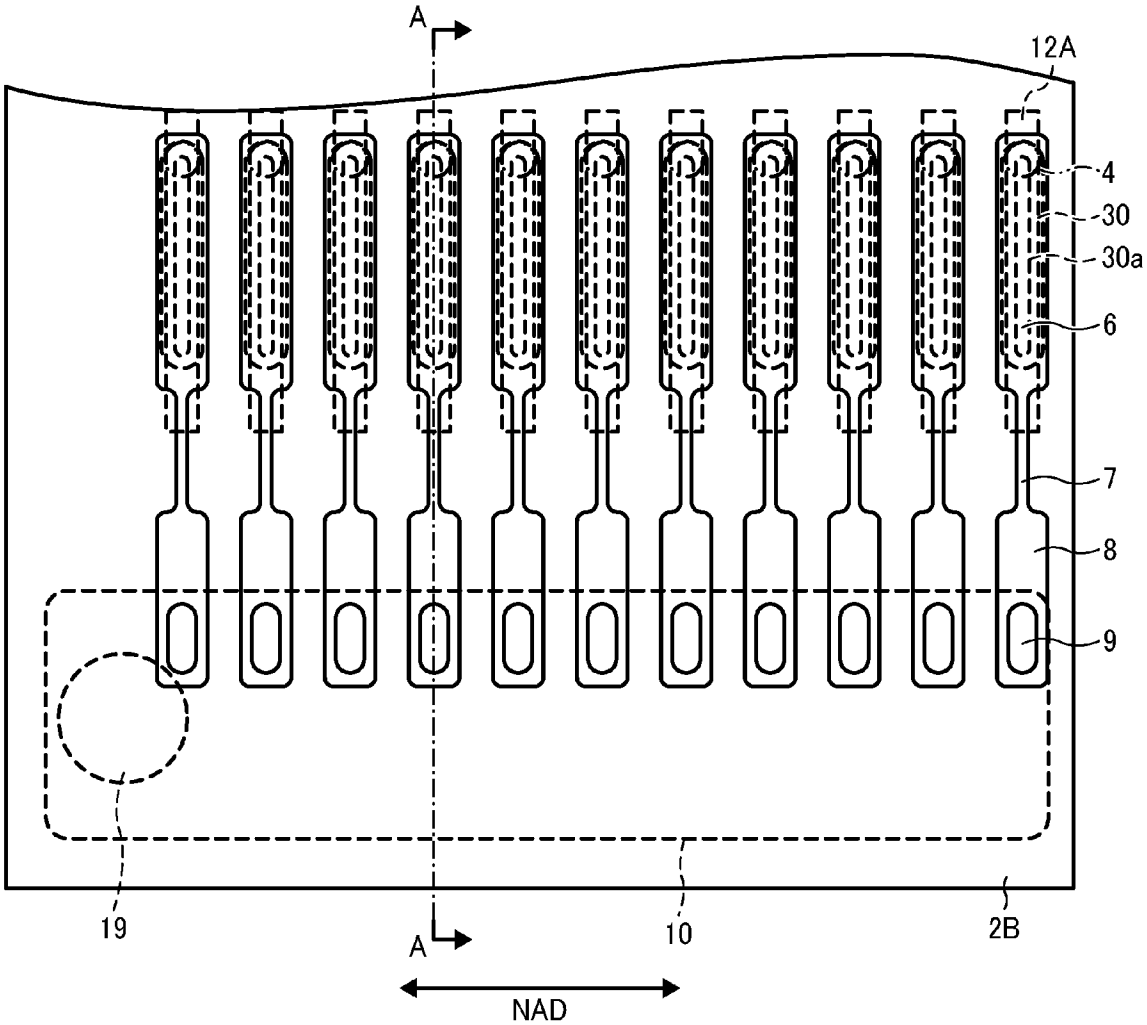
FIG. 3 is a plan view of a portion of the liquid discharge apparatus of FIG. 1 including a liquid discharge device.

Below, embodiments of the present disclosure are described with reference to the attached drawings. An outline of a liquid discharge head according to an embodiment of the present disclosure is described with reference to FIGS. 1 to 3. FIG. 1 is a cross-sectional view of the liquid discharge head according to the first embodiment, cut along line A-A of FIG. 3 in a direction (longitudinal direction of an individual liquid chamber) perpendicular to a nozzle array direction in which nozzles are arrayed in row. FIG. 2 is a cross-sectional view of the liquid discharge head cut along line B-B in the nozzle array direction (transverse direction of the individual liquid chamber), which is indicated by arrow NAD. FIG. 3 is a plan view of the liquid discharge head of FIG. 1 seen from a plate member as a top face.

A liquid discharge head 404 according to the first embodiment of the present disclosure includes a nozzle plate 1, a channel plate 2, and a diaphragm member 3 as a wall member that are laminated one on another and bonded to each other. The liquid discharge head 404 includes piezoelectric actuators 11 to displace the diaphragm member 3 and a frame member 20 as a common-liquid-chamber substrate.

The channel plate 2 constitutes individual liquid chambers 6 communicated with a plurality of nozzles 4 to discharge liquid, fluid restrictors 7, and liquid introduction portions 8.

Liquid is introduced from the common liquid chamber 10 of the frame member 20 through openings 9 of the diaphragm member 3 and supplied from the liquid introduction portions 8 to the individual liquid chambers 6 via the fluid restrictors 7. Note that filters may be disposed at the openings 9.

In the present embodiment, the nozzle plate 1 includes the nozzles 4 being nozzle orifices formed by pressing a stainless steel as a nozzle substrate. A liquid repellent film is disposed on a discharge side of the nozzle plate 1.

The channel plate 2 includes a plurality of (in the present embodiment, three) plate members 2A, 2B, and 2C laminated one on another in a thickness direction of the channel plate 2.

The diaphragm member 3 constitutes a wall face of each of the individual liquid chambers 6 of the channel plate 2 and has a two layer structure of a first layer 3A and a second layer 3B. Note that the number of layers of the diaphragm member 3 is not limited to two and may be one, or three or more. The first layer 3A facing the channel plate 2 includes a deformable vibration portions (diaphragms) 30 at areas corresponding to the individual liquid chambers 6.

The diaphragm member 3 is formed of a metal plate of nickel (Ni) and produced by electroforming. However, the material of the diaphragm member 3 is not limited to Ni. In some embodiments, other metal member or a member including a plurality of layers of resin and metal.

The piezoelectric actuators 11 including electromechanical transducer elements as driving devices (actuator devices or pressure generators) to deform the vibration portions 30 of the diaphragm member 3 are disposed at a first side of the diaphragm member 3 opposite a second side facing the individual liquid chambers 6.

The piezoelectric actuator 11 includes multi-layer piezoelectric members 12 bonded on a base 13 with adhesive. The piezoelectric members 12 are groove-processed by half cut dicing to form a desired number of pillar-shaped piezoelectric elements (piezoelectric pillars) 12A and pillar-shaped piezoelectric elements (piezoelectric pillars) 12B that are arranged in certain intervals to have a comb shape.

The piezoelectric elements 12A and the piezoelectric elements 12B of the piezoelectric member 12 are the same. The piezoelectric elements 12A are driven by application of a drive waveform. The piezoelectric elements 12B are used as simple pillars and are not applied with a drive waveform.

The piezoelectric elements 12A are bonded to projections 30*a* being island-shaped thick portions in the vibration portions 30 of the diaphragm member 3. The piezoelectric elements 12B are bonded to projections 30*b* being thick portions of the diaphragm member 3.

The piezoelectric member 12 includes piezoelectric layers and internal electrodes alternately laminated one on another. The internal electrodes are led out to end faces to form external electrodes. A flexible printed circuit (FPC) 15 as a flexible wiring member is connected to the external electrodes of the piezoelectric elements 12A to apply driving signals to the piezoelectric elements 12A.

The frame member 20 is formed by injection molding on, for example, epoxy resin or thermoplastic resin, such as polyphenylene sulfide, to include the common liquid chamber to supply liquid from a head tank or a liquid cartridge through a supply port 19.

In the liquid discharge head 404, for example, when a voltage applied to the piezoelectric element 12A is lowered from a reference potential (intermediate potential), the piezoelectric element 12A contracts. As a result, the vibration portion 30 of the diaphragm member 3 is drawn outward to increase the volume of the individual liquid chamber 6, thus causing liquid to flow into the individual liquid chamber 6.

When the voltage applied to the piezoelectric element 12A is raised, the piezoelectric element 12A expands in a direction of lamination. The vibration portion 30 of the diaphragm member 3 deforms in a direction toward the nozzle 4 and contracts the volume of the individual liquid chamber 6. Thus, liquid in the individual liquid chamber 6 is pressurized and discharged (jetted) from the nozzle 4.

When the voltage applied to the piezoelectric element 12A is returned to the reference potential, the vibration portion 30 of the diaphragm member 3 is returned to the initial position. Accordingly, the individual liquid chamber 6 expands to generate a negative pressure, thus replenishing liquid from the common liquid chamber 10 into the individual liquid chamber 6. After the vibration of a meniscus surface of the nozzle 4 decays to a stable state, the liquid discharge head 404 shifts to an operation for the next droplet discharge.

Note that the driving method of the liquid discharge head is not limited to the above-described example (pull-push discharge). For example, pull discharge or push discharge may be performed in response to the way to apply the drive waveform.

Figure 4:
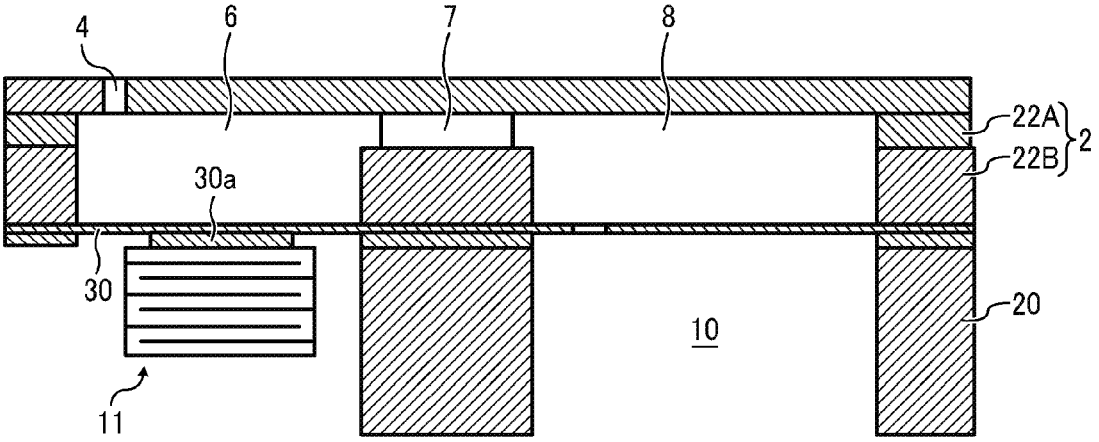
FIG. 4 is a cross-sectional view of a portion of the liquid discharge head according to a first embodiment of the present disclosure, cut in the direction perpendicular to the nozzle array direction.

Next, a first embodiment of the present disclosure is described with reference to FIGS. 4 and 5. FIG. 4 is a cross-sectional view of a portion of the liquid discharge head according to the first embodiment of the present disclosure, in the direction perpendicular to the nozzle array direction. FIGS. 5A and 5B are plan views of different examples of a plate member constituting a fluid restrictor of the liquid discharge head.

In the present embodiment, the channel plate 2 includes two plate members 22A and 22B. The fluid restrictor 7 is constituted by the nozzle plate 1, which is a plate member, and the plate members 22A and 22B constituting the channel plate 2.

Here, the fluid resistance value of the fluid restrictor 7 is defined by the plate member 22A being one of a plurality of plate members.

Figure 5A:
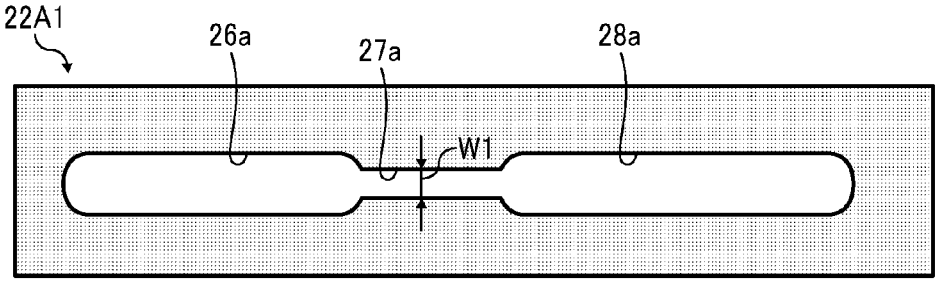
FIGS. 5A and 5B are plan views of different examples of a plate member constituting a fluid restrictor of the liquid discharge head of FIG. 4.
Figure 5B:
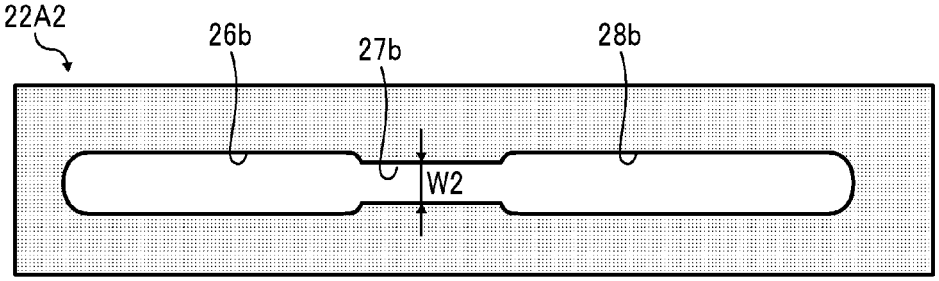

In other words, as illustrated in FIGS. 5A and 5B, the plate member 22A includes through holes 26 (26*a* and 26*b*) forming the individual liquid chambers 6, through holes 27 (27*a* and 27*b*) forming the fluid restrictors 7, and through holes 28 (28*a* and 28*b*) forming the liquid introduction portions 8.

In the present embodiment, a plate member 22A1 illustrated in FIG. 5A includes a through hole 27*a* that has a width W1 as a channel width w (a width in the direction perpendicular to the nozzle array direction) defining the fluid resistance value of the fluid restrictor 7. A plate member 22A2 illustrated in FIG. 5B includes a through hole 27*b* that has a width W2 as the channel width w defining the fluid resistance value of the fluid restrictor 7.

The fluid resistance value is obtained by the following formula 1 according to the shape of the channel and the viscosity of liquid.

Formula 1

In Formula 1, μ represents the viscosity of liquid, l represents the channel length, h represents the channel height, and w represents the channel width.

Accordingly, the fluid resistance value of the plate member 22A2 having a greater channel width w of the fluid restrictor 7 is smaller than the fluid resistance value of the plate member 22A1.

Hence, for example, to make a head having a configuration of discharging highly viscous liquid, the plate member 22A2 is used as the plate member 22A. To make a head having a configuration of discharging less viscous liquid, the plate member 22A1 is used as the plate member 22A.

As described above, the liquid discharge head having the fluid resistance value corresponding to, e.g., the viscosity of liquid can be made by changing only one plate member defining the fluid resistance value among the plurality of plate members constituting the fluid restrictor.

Figure 6:
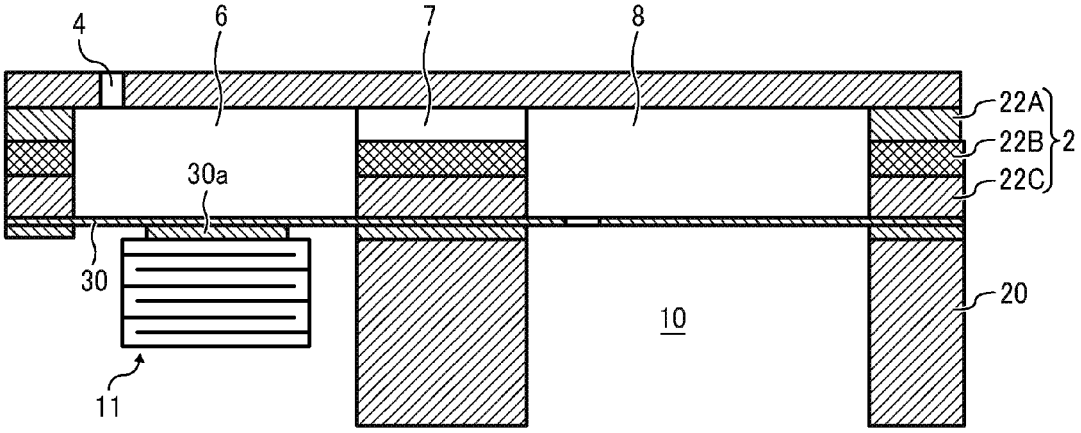
FIG. 6 is a cross-sectional view of a portion of the liquid discharge head according to a second embodiment of the present disclosure, cut in the direction perpendicular to the nozzle array direction.
Figure 7A:
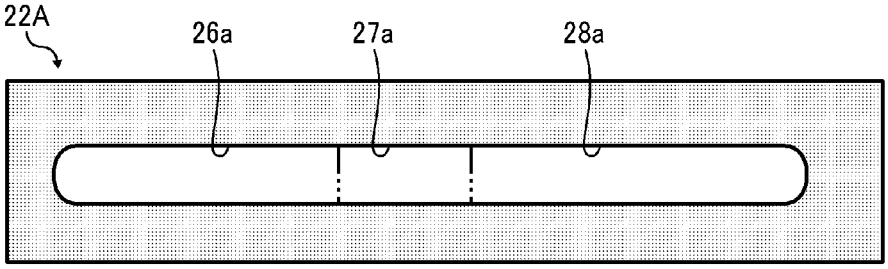
FIGS. 7A and 7B are plan views of plate members constituting a fluid restrictor of the liquid discharge head of FIG. 6.
Figure 7B:
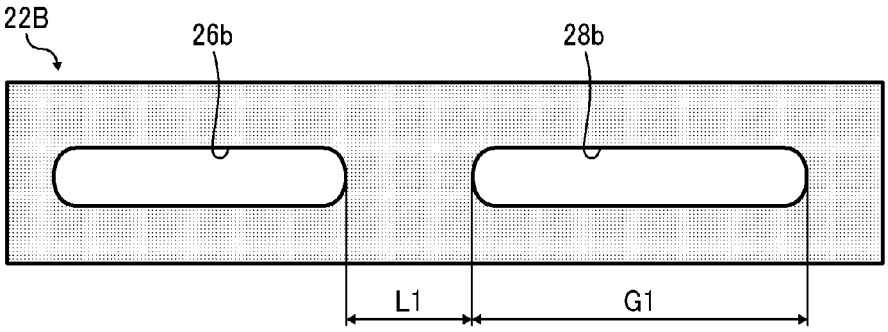

Next, a second embodiment of the present disclosure is described with reference to FIGS. 6, 7A, and 7B. FIG. 6 is a cross-sectional view of a portion of the liquid discharge head according to the second embodiment of the present disclosure, in the direction perpendicular to the nozzle array direction. FIGS. 7A and 7B are plan views of plate members constituting a fluid restrictor of the liquid discharge head of FIG. 6.

In the present embodiment, the channel plate 2 includes three plate members 22A, 22B, and 22C. The fluid restrictor 7 is constituted by the nozzle plate 1, which is a plate member, and the plate members 22A and 22B constituting the channel plate 2.

The fluid resistance value of the fluid restrictor 7 is defined by the plate member 22B being one of a plurality of plate members.

In other words, as illustrated in FIG. 7A, the plate member 22A includes a through hole 26 forming the individual liquid chamber 6, a through hole 27*a* forming the fluid restrictor 7, and a through hole 28*a* forming the liquid introduction portion 8.

On the other hand, as illustrated in FIG. 7B, the plate member 22B includes a through hole 26*b* forming the individual liquid chamber 6 and the through hole 28*b* forming the liquid introduction portion 8. The through hole 26*b* and the through hole 28*b* are spaced apart from each other by a distance L1 in the direction perpendicular to the nozzle array direction NAD.

Since the distance L1 between the through hole 26*b* and the through hole 28*b* of the plate member 22B is a channel length l of the fluid restrictor 7, the fluid resistance value of the fluid restrictor 7 is defined by the single plate member 22B.

Hence, the fluid resistance value of the fluid restrictor 7 can be changed by, for example, using the plate member 22B having a different distance L1 due to a different length G1 of the through hole 28*b*.

Thus, the liquid discharge head having the fluid resistance value corresponding to, e.g., the viscosity of liquid can be made by changing only one plate member defining the fluid resistance value among the plurality of plate members constituting the fluid restrictor.

Figure 8:
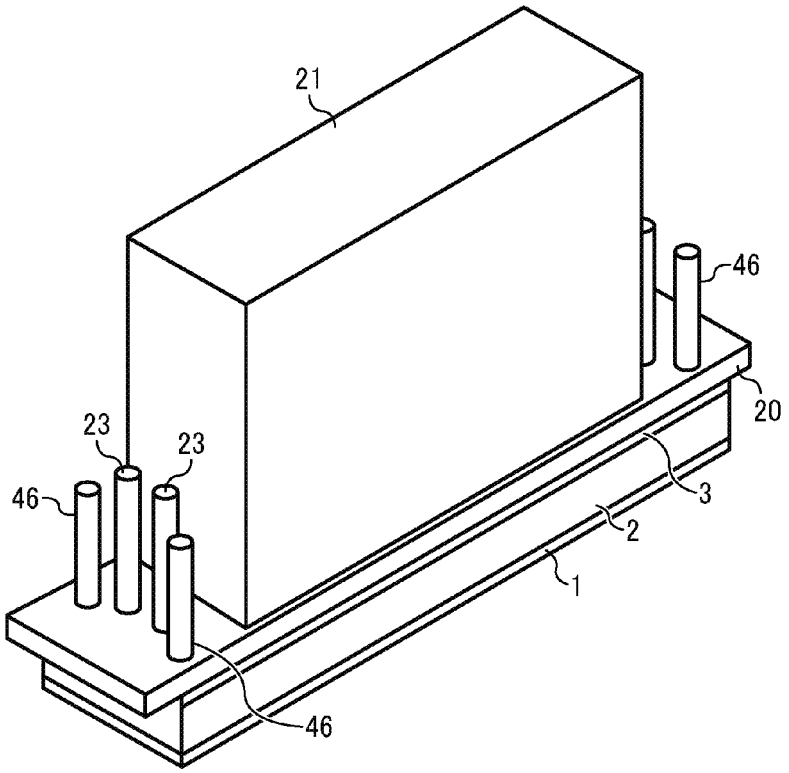
FIG. 8 is an outer perspective view of a liquid discharge head according to a third embodiment of the present disclosure.
Figure 9:
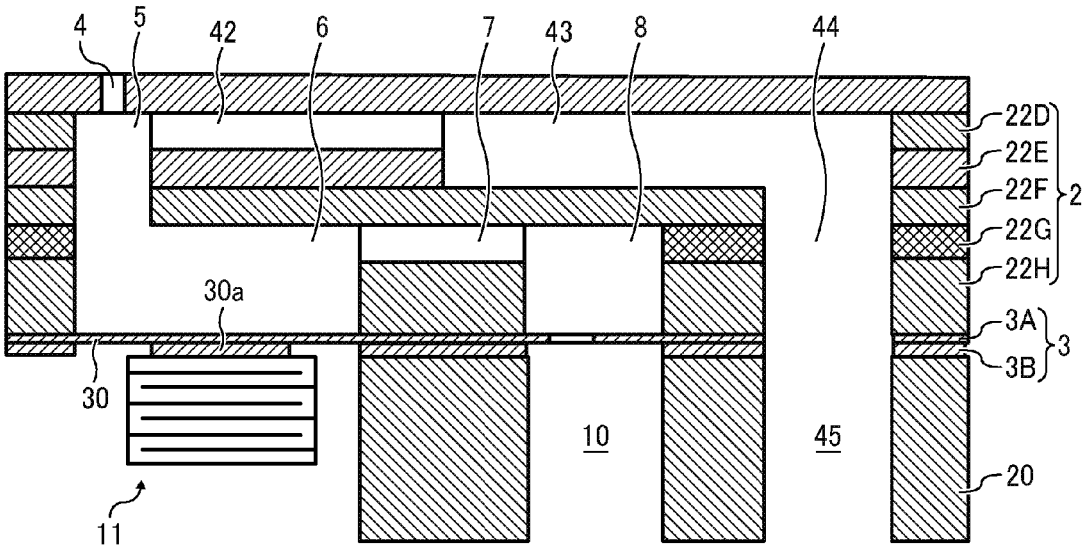
FIG. 9 is a cross-sectional view of a portion of the liquid discharge head of FIG. 8 cut along the direction perpendicular to the nozzle array direction.

Next, a third embodiment of the present disclosure is described with reference to FIGS. 8 to 11B. FIG. 8 is an outer perspective view of the liquid discharge head according to the third embodiment. FIG. 9 is a cross-sectional view of a portion of the liquid discharge head of FIG. 8 in the direction perpendicular to the nozzle array direction. FIG. 10 is a plan view of plate members constituting the fluid restrictor of the liquid discharge head of FIG. 8. FIG. 11 is a plan view of plate members constituting a circulation fluid restrictor of the liquid discharge head of FIG. 8. Note that the same reference codes are allocated to portions corresponding to the portions described in the first embodiment, and descriptions of the portions are omitted or simplified below.

The liquid discharge head 404 according to the fourth embodiment of the present disclosure includes the nozzle plate 1, the channel plate 2, and the diaphragm member 3 as a wall member that are laminated one on another and bonded to each other. The liquid discharge head 404 includes piezoelectric actuators 11 to displace the vibration portion 30 of the diaphragm member 3, a frame member 20 as a common-liquid-chamber substrate, and a cover 21.

As illustrated in FIG. 9, the channel plate 2 includes circulation channels 43 at a side at which the nozzle plate 1 is disposed. The circulation channel 43 is communicated with the nozzle passage 5, which communicates the nozzle 4 with the individual liquid chamber 6, via the circulation fluid restrictor 42. The circulation channel 43 is communicated with the circulation common-liquid chamber 45 of the frame member 20 via a passage 44 extending in a direction perpendicular to a surface of the channel plate 2.

As illustrated in FIG. 8, the frame member 20 includes supply ports 23 communicated with the common liquid chambers 10 and circulation ports (delivery ports) 46 communicated with the circulation common-liquid chambers 45.

In the present embodiment, the channel plate 2 includes five plate members 22D, 22E, 22F, 22G, and 22H. The fluid restrictor 7 is constituted by the three plate members 22F, 22G, and 22H, which are laminated one on another, constituting the channel plate 2 being a plate member. The circulation fluid restrictor 42 is constituted by the nozzle plate 1, which is a plate member, and the two plate members 22D and 22E constituting the channel plate 2. The nozzle plate 1 and the two plate members 22D and 22E are laminated one on another.

The fluid resistance value of the fluid restrictor 7 is defined by the plate member 22G being one of a plurality of plate members.

Figure 10A:
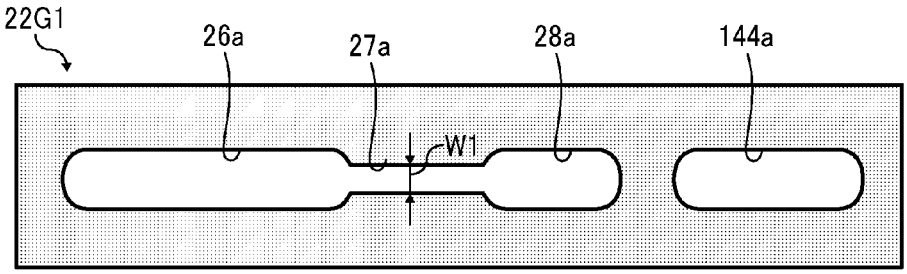
FIGS. 10A and 10B are plan views of plate members constituting a fluid restrictor of the liquid discharge head of FIG. 9.
Figure 10B:
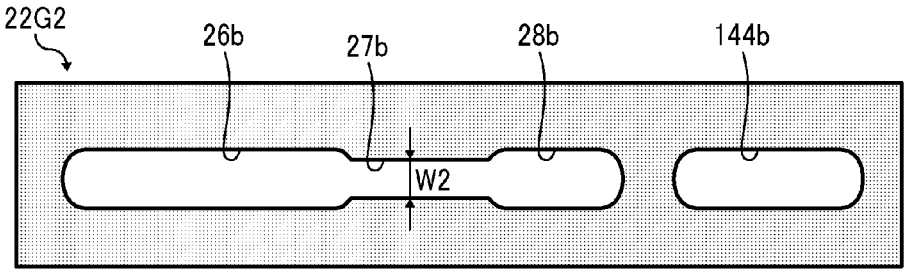

In other words, as illustrated in FIGS. 10A and 10B, the plate member 22G includes through holes 26 (26*a* and 26*b*) forming the individual liquid chambers 6, through holes 27 (27*a* and 27*b*) forming the fluid restrictors 7, through holes 28 (28*a* and 28*b*) forming the liquid introduction portions 8, and through holes 144 (144*a* and 144*b*) forming the passage 44.

In the present embodiment, a plate member 22G1 illustrated in FIG. 10A includes a through hole 27*a* that has a width W1 as a channel width w (a width in the direction perpendicular to the nozzle array direction) defining the fluid resistance value of the fluid restrictor 7. A plate member 22G2 illustrated in FIG. 10B includes the through hole 27*b* that has a width W2 (W1<W2) as the channel width w defining the fluid resistance value of the fluid restrictor 7.

Accordingly, the fluid resistance value of the plate member 22G2 having a greater channel width w of the fluid restrictor 7 is smaller than the fluid resistance value of the plate member 22G1.

Accordingly, the liquid discharge head having the fluid resistance value corresponding to, e.g., the viscosity of liquid can be made by changing only one plate member defining the fluid resistance value among the plurality of plate members constituting the fluid restrictor.

The fluid resistance value of the circulation fluid restrictor 42 is defined by the plate member 22D being one of a plurality of plate members.

Figure 11A:
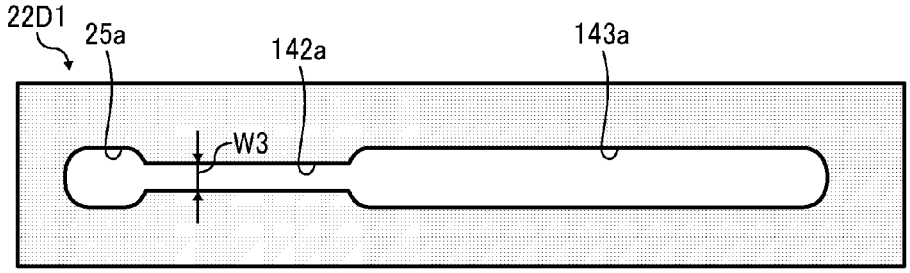
FIGS. 11A and 11B are plan views of plate members constituting the fluid restrictor of the liquid discharge head of FIG. 9.
Figure 11B:
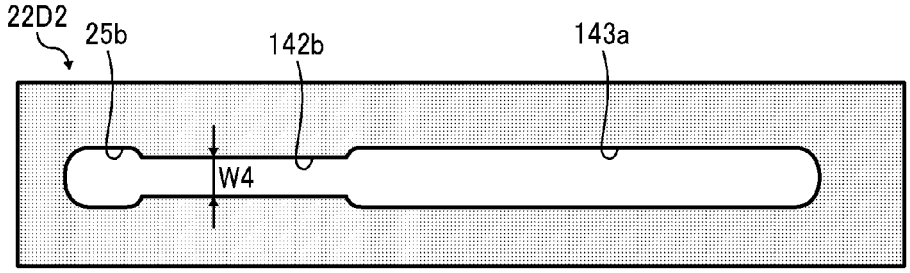

In other words, as illustrated in FIGS. 11A and 11B, the plate member 22D includes through holes 25 (25*a* and 25*b*) forming the nozzle passage 5, through holes 142 (142*a* and 142*b*) forming the circulation fluid restrictor 42, and through holes 143 (143*a* and 143*b*) forming the circulation channel 43.

In the present embodiment, a plate member 22D1 illustrated in FIG. 11A includes the through hole 142*a* that has a width W3 as a channel width w (a width in the direction perpendicular to the nozzle array direction) defining the fluid resistance value of the circulation fluid restrictor 42. A plate member 22D2 illustrated in FIG. 11B includes the through hole 142*b* that has a width W4 (W3<W4) as the channel width w defining the fluid resistance value of the circulation fluid restrictor 42.

Accordingly, the fluid resistance value of the plate member 22D2 having a greater channel width w of the circulation fluid restrictor 42 is smaller than the fluid resistance value of the plate member 22D1.

Accordingly, the liquid discharge head having the fluid resistance value corresponding to, e.g., the viscosity of liquid can be made by changing only one plate member defining the fluid resistance value among the plurality of plate members constituting the circulation fluid restrictor.

Figure 12:
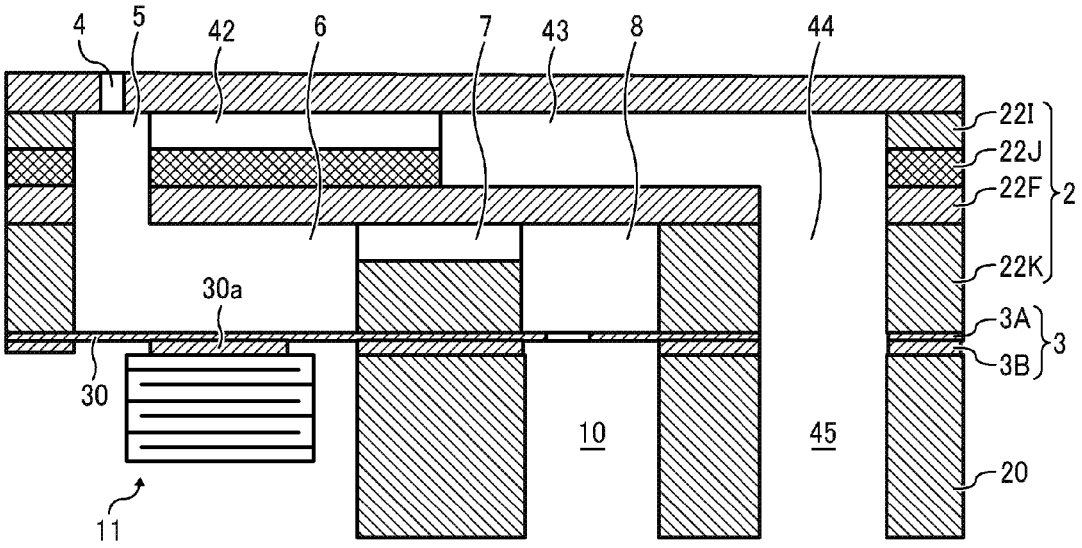
FIG. 12 is a cross-sectional view of a portion of the liquid discharge head according to a fourth embodiment of the present disclosure, cut in the direction perpendicular to the nozzle array direction.
Figure 13A:
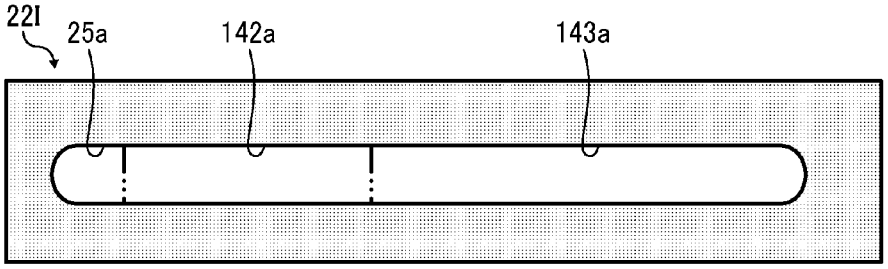
FIGS. 13A and 13B are plan views of plate members constituting the fluid restrictor of the liquid discharge head of FIG. 12.
Figure 13B:
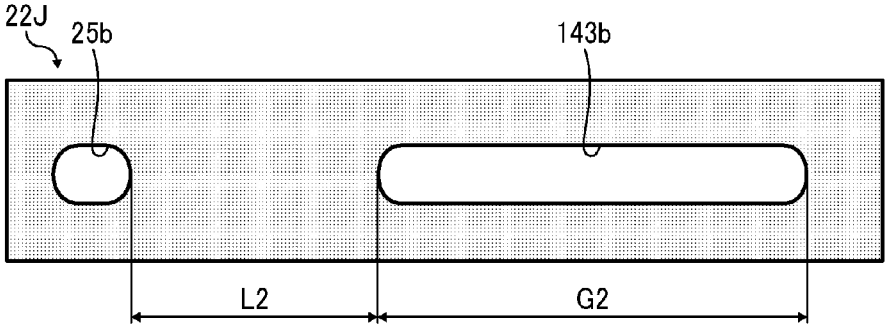

Next, a fourth embodiment of the present disclosure is described with reference to FIGS. 12, 13A, and 13B. FIG. 12 is a cross-sectional view of a portion of the liquid discharge head according to the fourth embodiment of the present disclosure, in the direction perpendicular to the nozzle array direction. FIGS. 13A and 13B are plan views of plate members constituting the circulation fluid restrictor of the liquid discharge head of FIG. 12.

In the present embodiment, the liquid discharge head 404 includes the nozzle plate 1 and the channel plate 2. The nozzle plate 1 is a laminated plate member constituting the individual liquid chamber 6, the fluid restrictor 7, the circulation channel 43, and the circulation fluid restrictor 42. The channel plate 2 is constituted by four plate members 22I, 22J, 22F, and 22K.

The fluid restrictor 7 is constituted by the two laminated plate members 22F and 22K constituting the channel plate 2 being a plate member. The circulation fluid restrictor 42 is constituted by the nozzle plate 1, which is a plate member, and the two plate members 22I and 22J constituting the channel plate 2. The nozzle plate 1 and the two plate members 22I and 22J are laminated one on another.

The fluid resistance value of the fluid restrictor 7 is defined by the plate member 22K being one of a plurality of plate members.

Accordingly, the liquid discharge head having the fluid resistance value corresponding to, e.g., the viscosity of liquid can be made by changing only one plate member defining the fluid resistance value among the plurality of plate members constituting the fluid restrictor.

The fluid resistance value of the circulation fluid restrictor 42 is defined by the plate member 22J being one of a plurality of plate members.

In other words, as illustrated in FIG. 13A, the plate member 22I includes a through-hole portion that constitutes a through hole 25*a* forming the nozzle passage 5, a through hole 142*a* forming the circulation fluid restrictor 42, and a through hole 143*a* forming the circulation channel 43. As illustrated in FIG. 13B, the plate member 22J includes a through hole 25*b* forming the nozzle passage 5 and the through holes 143*b* forming the circulation channel 43. The through hole 25*b* and the through holes 143*b* are spaced apart from each other by a distance L2 in the direction perpendicular to the nozzle array direction.

Since the distance L2 between the through hole 25*b* and the through hole 143*b* of the plate member 22J is a channel length l of the circulation fluid restrictor 42, the fluid resistance value of the circulation fluid restrictor 42 is defined by the single plate member 22J.

Hence, the fluid resistance value of the circulation fluid restrictor 42 can be changed by, for example, using the plate member 22J having a different distance L2 due to a different length G2 of the through holes 143*b*.

Accordingly, the liquid discharge head having the fluid resistance value corresponding to, e.g., the viscosity of liquid can be made by changing only one plate member defining the fluid resistance value among the plurality of plate members constituting the circulation fluid restrictor.

Figure 14:
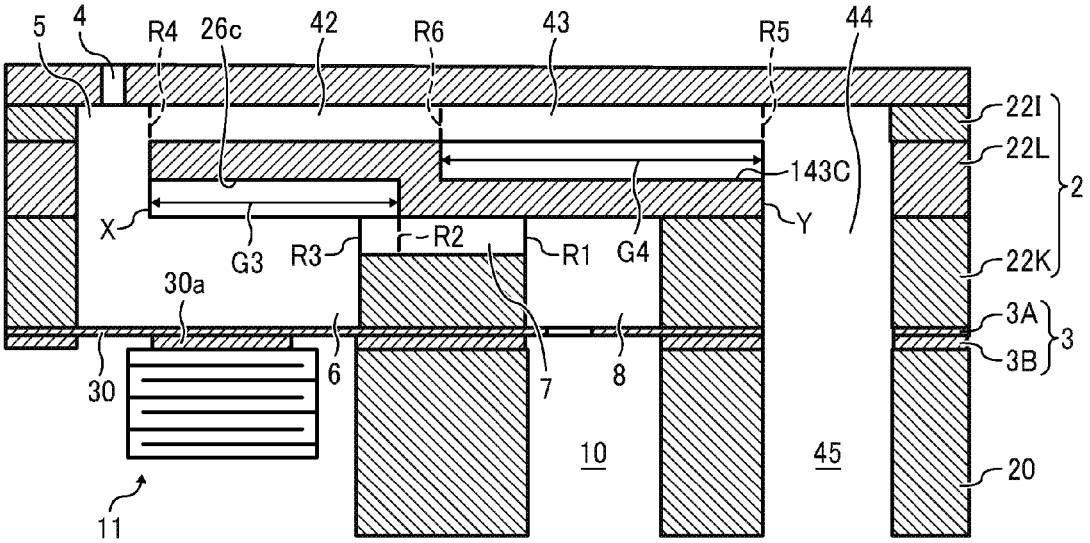
FIG. 14 is a cross-sectional view of a portion of the liquid discharge head according to a fifth embodiment of the present disclosure, cut in the direction perpendicular to the nozzle array direction.
Figure 15:
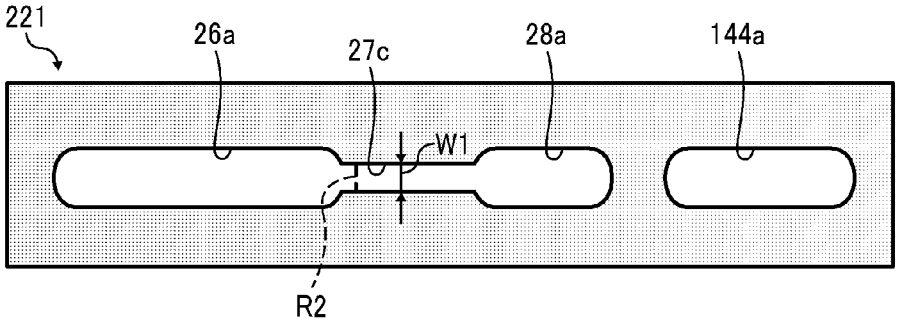
FIG. 15 is a plan view of a plate member constituting a fluid restrictor of the liquid discharge head of FIG. 14.
Figure 16:
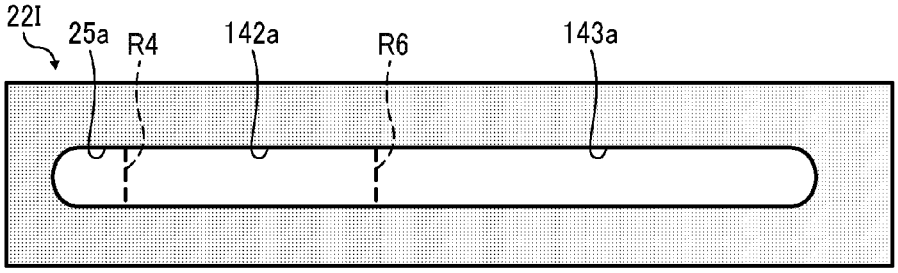
FIG. 16 is a plan view of a plate member constituting the fluid restrictor of the liquid discharge head of FIG. 14.

Next, a fifth embodiment of the present disclosure is described with reference to FIGS. 14 to 16. FIG. 14 is a cross-sectional view of a portion of the liquid discharge head according to the fifth embodiment of the present disclosure, cut in the direction perpendicular to the nozzle array direction. FIG. 15 is a plan view of a plate member constituting the fluid restrictor of the liquid discharge head of FIG. 14. FIG. 16 is a plan view of a plate member constituting the circulation fluid restrictor of the liquid discharge head of FIG. 14.

In the present embodiment, the liquid discharge head 404 includes the nozzle plate 1 and the channel plate 2. The nozzle plate 1 is a laminated plate member constituting the individual liquid chamber 6, the fluid restrictor 7, the circulation channel 43, and the circulation fluid restrictor 42. The channel plate 2 is constituted by three plate members 22I, 22K, and 22K.

The plate member 22K includes a through holes 26*a* forming the individual liquid chamber 6, a groove 27*c* forming the fluid restrictor 7, a through hole 28*a* forming the liquid introduction portion 8, and a through hole 144*a* forming the passage 44.

The plate member 22I includes a through-hole portion that constitutes a through hole 25*a* forming the nozzle passage 5, a through hole 142*a* forming the circulation fluid restrictor 42, and a through hole 143*a* forming the circulation channel 43.

The plate member 22L includes a recessed portion 26*c* forming part of the individual liquid chamber 6 and a recessed portion 143*c* forming part of the circulation channel 43.

The recessed portion 26*c* and the recessed portion 143*c* are part of a channel through which fluid flows. The plate member 22L is a plate member disposed between the fluid restrictor 7 and the circulation fluid restrictor 42 to separate a supply-side channel (the liquid introduction portion 8, the fluid restrictor 7, and the individual liquid chamber 6) from a circulation-side channel (the circulation fluid restrictor 42 and the circulation channel 43).

In the present embodiment, the recessed portion 26*c* is disposed across an area from a surface X of the plate member 22L opposing the nozzle passage 5 to a surface of the plate member 22L opposing the fluid restrictor 7. The recessed portion 143*c* is disposed across an area from a surface Y of the plate member 22L opposing the passage 44 to a surface of the plate member 22L opposing the circulation fluid restrictor 42.

The recessed portion 26*c* is disposed adjacent to the fluid restrictor 7 in the direction of flow of liquid. The recessed portion 143*c* is disposed adjacent to the circulation fluid restrictor 42 in the direction of flow of liquid.

Accordingly, the length G3 of the recessed portion 26*c* and the length G4 of the recessed portion 143*c* of the plate member 22L are different from each other in the direction perpendicular to the nozzle array direction (the longitudinal direction of the individual liquid chamber). Thus, the fluid resistance value of the fluid restrictor 7 differs from the fluid resistance value of the circulation fluid restrictor 42.

Hence, the fluid resistance value of the fluid restrictor 7 differs from the fluid resistance value of the circulation fluid restrictor 42 by using the plate member 22L in which the length G3 of the recessed portion 26*c* is different from the length G4 of the recessed portion 143*c*.

In other words, in the present embodiment, the plate member 22L is a common plate member that defines the fluid resistance value of each of the fluid restrictor 7 at the supply side and the circulation fluid restrictor 42 at the circulation side.

Accordingly, the liquid discharge head having the fluid resistance value of the fluid restrictor and the fluid resistance value of the circulation fluid restrictor corresponding to the viscosity of liquid can be made by changing only one plate member defining the fluid resistance value among the plurality of plate members.

Here, a further description is given of the reason that the fluid resistance value of the fluid restrictor 7 and the fluid resistance value of the circulation fluid restrictor 42 can be defined by the recessed portion 26*c* and the recessed portion 143*c*.

As can be seen from FIG. 14, if the recessed portion 26*c* is not provided, a range from R1 to R2 of the fluid restrictor 7 would act as fluid resistance. In the present embodiment, the plate member 22L includes the recessed portion 26*c* and a portion of the recessed portion 26*c* is disposed opposing the groove 27*c* forming the fluid restrictor 7. Accordingly, in the example of FIG. 14, a range from R1 to R3 of the fluid restrictor 7 acts as fluid resistance. A range from R3 to R2 does not act as fluid resistance because the cross-sectional area of the channel increases.

Thus, the fluid resistance of the fluid restrictor 7 can be defined by the length G3 of the recessed portion 26*c*. The fluid resistance of the fluid restrictor 7 can be easily changed by changing the length G3 of the recessed portion 26*c*.

Similarly, if the recessed portion 143*c* is not provided, the circulation fluid restrictor 42 a range from R4 to R5 would act as fluid resistance. In the present embodiment, the plate member 22L includes the recessed portion 143*c*. Accordingly, in the example of FIG. 14, a range from R4 to R6 of the circulation fluid restrictor 42 acts as fluid resistance. A range from R6 to R5 of the circulation fluid restrictor 42 does not act as fluid resistance because the cross-sectional area of the channel increases.

Thus, the fluid resistance of the circulation fluid restrictor 42 can be defined by the length G3 of the recessed portion 143*c*. The fluid resistance of the circulation fluid restrictor 42 can be easily changed by changing the length G4 of the recessed portion 143*c*.

Since the recessed portion 26*c* and the recessed portion 143*c* are formed in the single plate member 22L, the fluid resistance of both of the fluid restrictor 7 and the fluid resistance can be changed and adjusted by replacing the plate member 22L.

In the present embodiment, the width W of the groove 27*c* of the plate member 22K is narrow. However, when the width W is not narrow, the fluid resistance can be changed. Similarly, a portion of the through hole 142*a* of the plate member 22I may be narrow.

The configuration of defining the fluid resistance is not limited to the recessed portion. For example, another tubular passage may be disposed near the fluid restrictor.

Such a configuration can increase the cross-sectional area of the channel, thus allowing a change in fluid resistance.

Alternatively, the fluid resistance can be adjusted by changing the surface roughness of the plate member. For example, the surface of a portion of the plate member 22L opposing the fluid restrictor 7 may be roughened or the surface of a portion of the plate member 22L opposing the circulation fluid restrictor 42 may be smoothed to change the fluid resistance.

Next, an example of a liquid circulation system that includes the liquid discharge head having the circulation channel is described with reference to FIG. 17.

Figure 17:
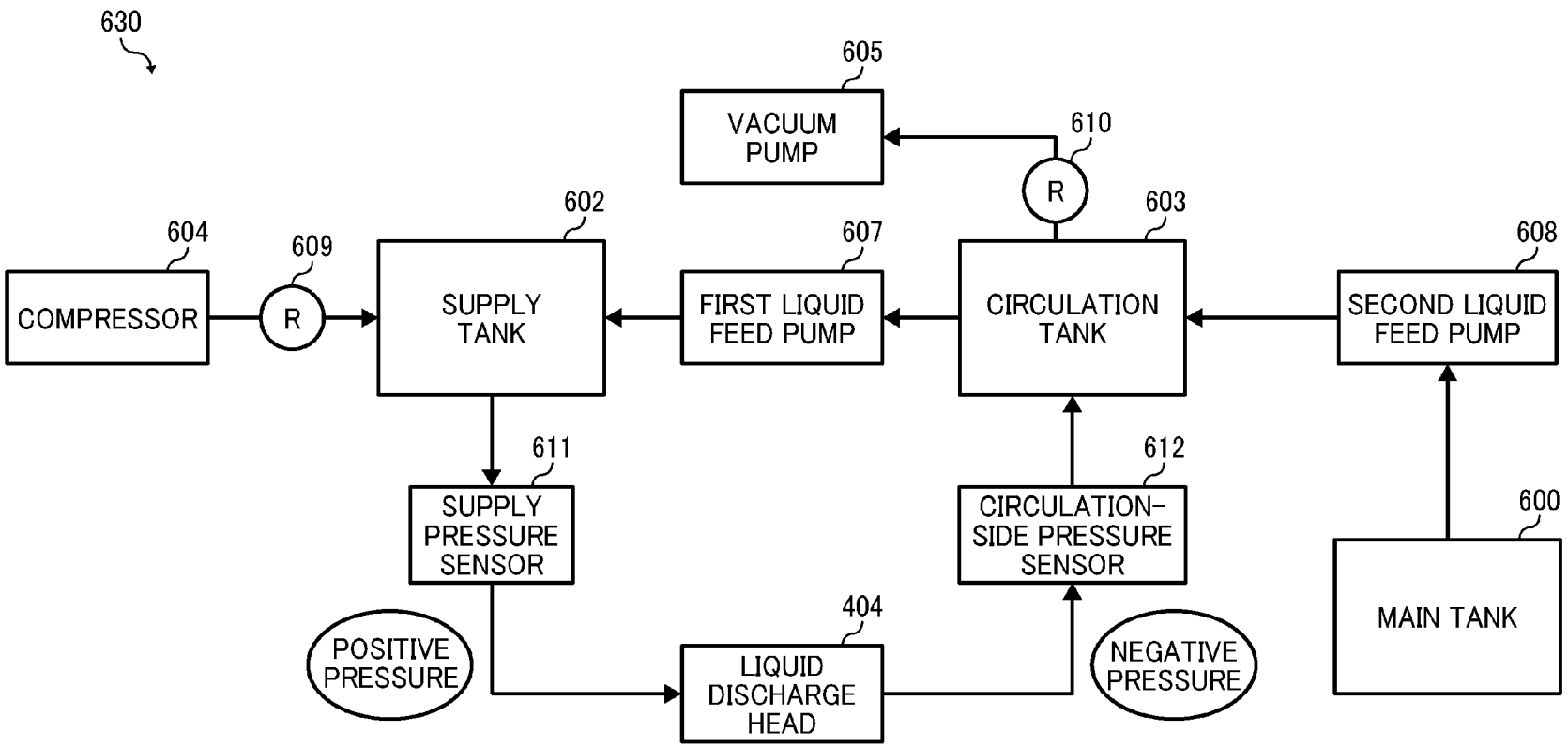
FIGS. 17 is a block diagram of an example of a liquid circulation system that includes a liquid discharge head having a circulation channel according to an embodiment of the present disclosure.

A liquid circulation system 630 illustrated in FIG. 17 includes, e.g., a main tank 600, the liquid discharge head 404, a supply tank 602, a circulation tank 603, a compressor 604, a vacuum pump 605, a first liquid feed pump 607, a second liquid feed pump 608, a regulator (R) 609, a regulator (R) 610, a supply-side pressure sensor 611, and a circulation-side pressure sensor 612.

The supply-side pressure sensor 611 is disposed between the supply tank 602 and the liquid discharge head 404 and connected to a supply channel connected to the supply ports 23 of the liquid discharge head 404. The circulation-side pressure sensor 612 is disposed between the liquid discharge head 404 and the circulation tank 603 and is connected to a circulation channel side connected to the circulation ports 46 of the liquid discharge head 404.

One end of the circulation tank 603 is connected to the supply tank 602 via the first liquid feed pump 607 and the other end of the circulation tank 603 is connected to the main tank 600 via the second liquid feed pump 608.

Accordingly, liquid flows from the supply tank 602 into the liquid discharge head 404 via the supply ports 23, is delivered from the circulation ports 46 into the circulation tank 603, and fed from the circulation tank 603 to the supply tank 602 by the first liquid feed pump 607, thus allowing circulation of liquid.

The supply tank 602 is connected to the compressor 604 and controlled so that a predetermined positive pressure is detected with the supply-side pressure sensor 611. By contrast, the circulation tank 603 is connected to the vacuum pump 605 and controlled so that a predetermined negative pressure is detected with the circulation-side pressure sensor 612.

Such a configuration allows the menisci of ink to be maintained at a constant negative pressure while circulating ink through the inside of the liquid discharge head 404.

When liquid is discharged from nozzles of the liquid discharge head 404, the amount of ink in the supply tank 602 and the circulation tank 603 decreases. Accordingly, liquid is replenished from the main tank 600 to the circulation tank 603 with the second liquid feed pump 608. The replenishment of liquid from the main tank 600 to the circulation tank 603 is controlled in accordance with a result of detection with, e.g., a liquid level sensor in the circulation tank 603, for example, in a manner in which liquid is replenished when the liquid level of liquid in the circulation tank 603 is lower than a predetermined height.

Figure 18:
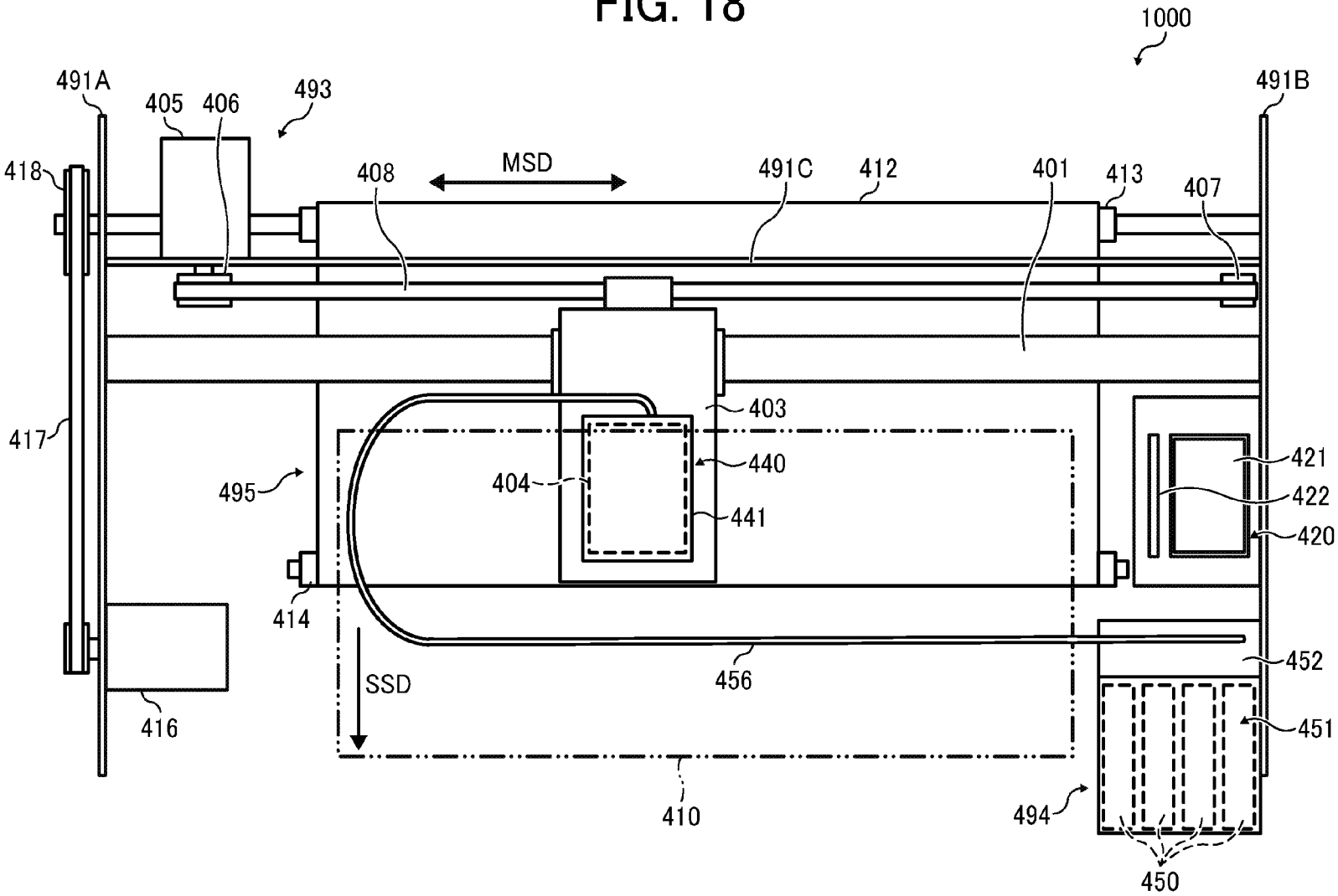
FIG. 18 is a plan view of a portion of a liquid discharge apparatus including a liquid discharge device, according to an embodiment of the present disclosure.
Figure 19:
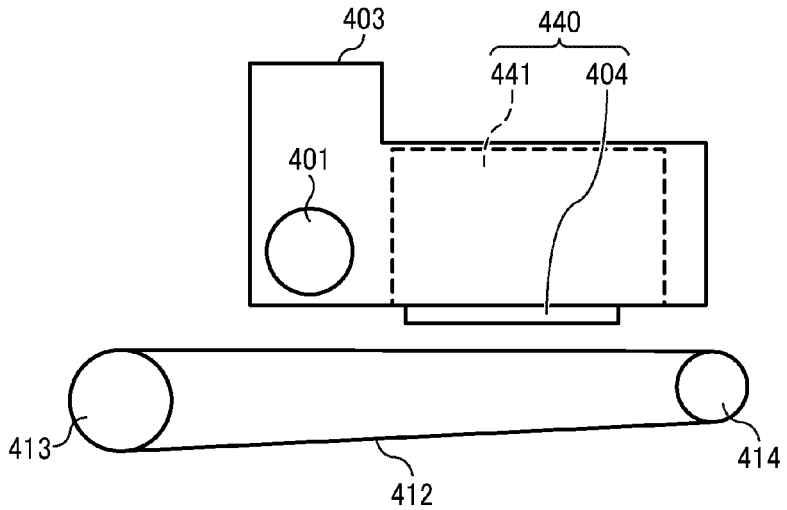
FIG. 19 is a side view of a portion of the liquid discharge apparatus of FIG. 18.

Next, a liquid discharge apparatus 1000 according to an embodiment of the present disclosure is described with reference to FIGS. 18 and 19. FIG. 18 is a plan view of a portion of the liquid discharge apparatus according to an embodiment of the present disclosure. FIG. 19 is a side view of a portion of the liquid discharge apparatus of FIG. 18.

A liquid discharge apparatus 1000 according to the present embodiment is a serial-type apparatus in which a main scan moving unit 493 reciprocally moves a carriage 403 in a main scanning direction indicated by arrow MSD in FIG. 15. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 18, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount liquid cartridges 450, a tube 456, and a liquid feed unit 452 including a liquid feed pump.

The liquid cartridge 450 is detachably attached to the cartridge holder 451. The liquid is supplied to the head tank 441 by the liquid feed unit 452 via the tube 456 from the liquid cartridges 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 1000 thus configured, the sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 404 according to an embodiment of the present disclosure, thus allowing stable formation of high quality images.

Figure 20:
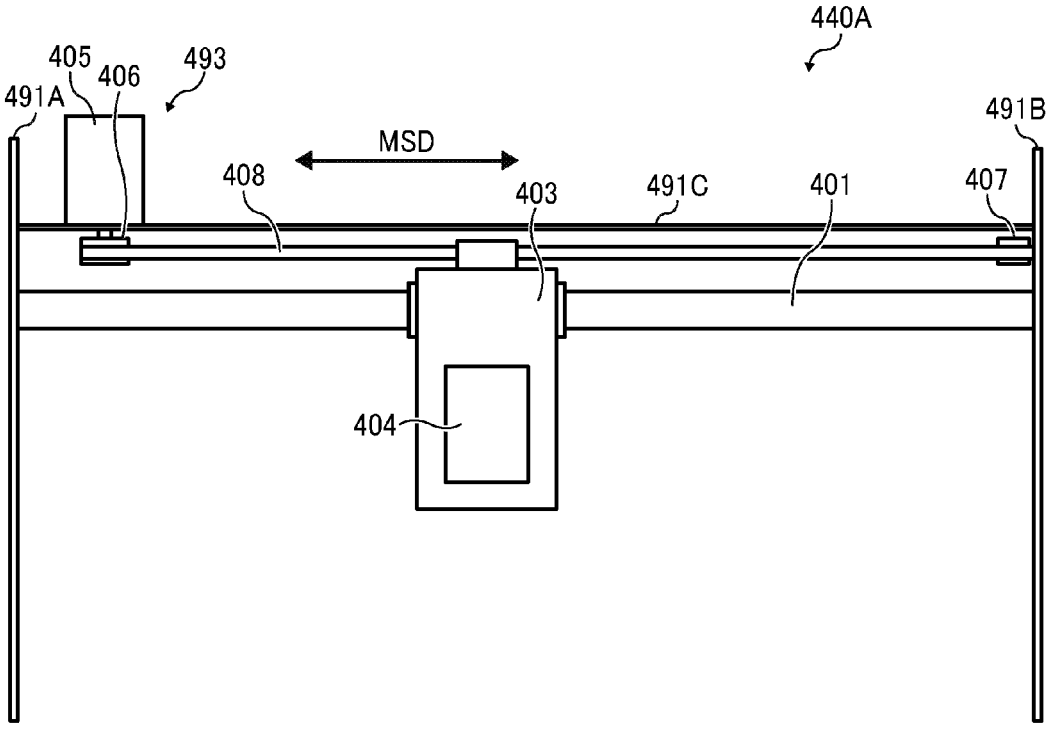
FIG. 20 is a plan view of a portion of another example of the liquid discharge device.

Next, another example of the liquid discharge device according to an embodiment of the present disclosure is described with reference to FIG. 20. FIG. 20 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 1000. The left side plate 491A, the right side plate 491B, and the rear side plate 491C constitute the housing.

Note that, in the liquid discharge device 440A, at least one of the maintenance unit 420 and the supply unit 494 may be mounted on, for example, the right side plate 491B.

Figure 21:
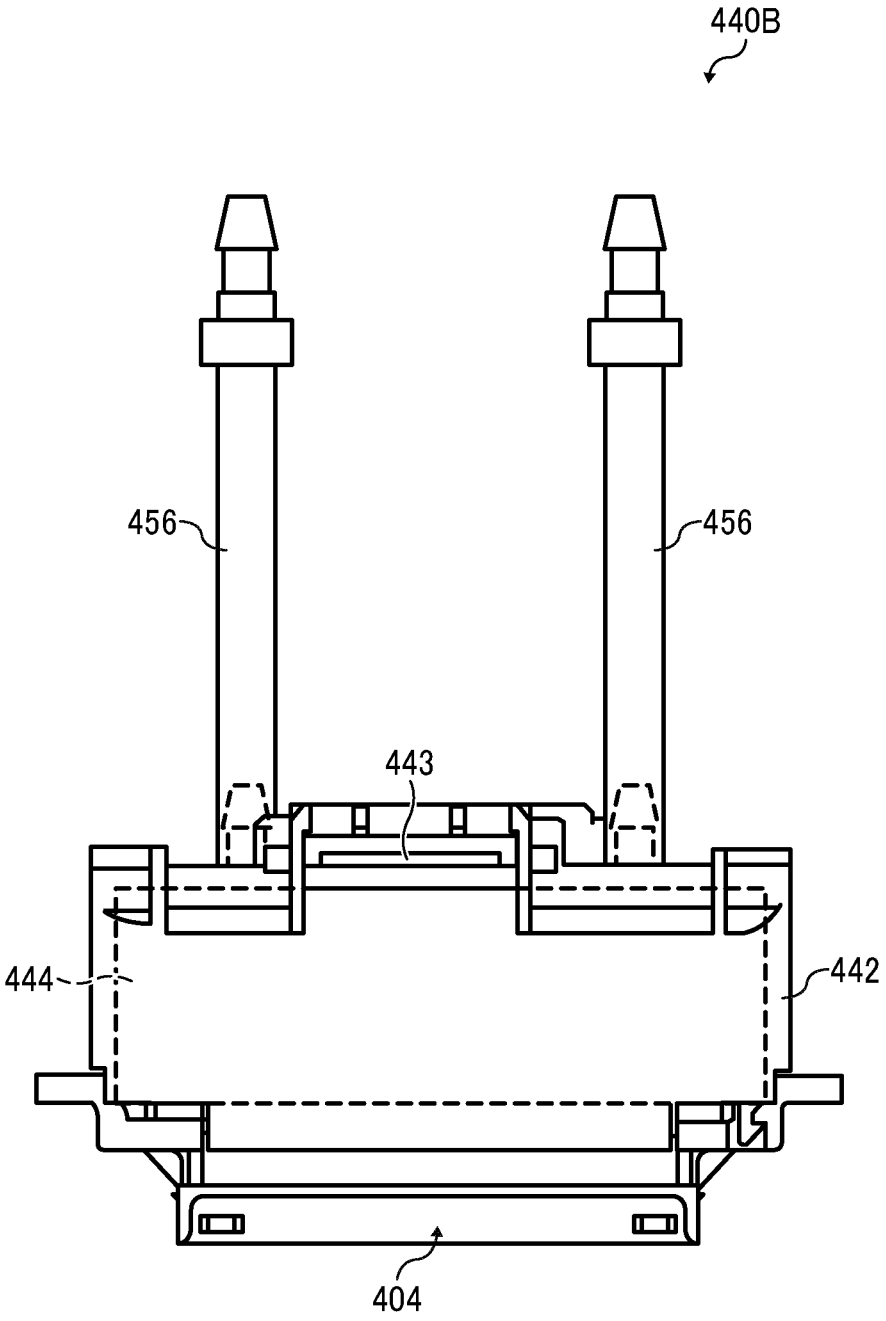
FIG. 21 is a front view of still another example of the liquid discharge device.

Next, still another example of the liquid discharge device according to an embodiment of the present disclosure is described with reference to FIG. 21. FIG. 21 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. The liquid discharge device may include the liquid discharge head, the carriage, and the main scan moving unit that are integrated as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit. Liquid is supplied from a liquid reservoir source to the liquid discharge head.

The main-scan moving unit may be a guide only. The supply unit may be a tube(s) only or a loading unit only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:
- a nozzle to discharge liquid;
- an individual liquid chamber communicated with the nozzle;
- a common liquid chamber to supply the liquid to the individual liquid chamber;
- a fluid restrictor disposed between the individual liquid chamber and the common liquid chamber;
- a circulation channel communicated with the individual liquid chamber;
- a circulation fluid restrictor disposed between the individual liquid chamber and the circulation channel; and
- a plurality of laminated plate members constituting the fluid restrictor, the individual liquid chamber, and the circulation fluid restrictor,
- a single plate member of the plurality of laminated plate members defining a fluid resistance value of the fluid restrictor and a fluid resistance value of the circulation fluid restrictor.

2. The liquid discharge head according to claim 1, wherein the single plate member includes a portion of a channel through which the liquid flows.

3. The liquid discharge head according to claim 2, wherein the portion of the channel is a recessed portion.

4. The liquid discharge head according to claim 3, wherein the recessed portion is disposed at a surface of the single plate member opposing the fluid restrictor.

5. The liquid discharge head according to claim 3, wherein the recessed portion is disposed at a surface of the single plate member opposing the circulation fluid restrictor.

6. The liquid discharge head according to claim 2,
- wherein the single plate member includes a plurality of recessed portions, and
- wherein the plurality of recessed portions is disposed at a first surface of the single plate member opposing the fluid restrictor and a second surface of the single plate member opposing the circulation fluid restrictor.

7. The liquid discharge head according to claim 6,
- wherein one of the plurality of recessed portions at the first surface of the single plate member is disposed adjacent to the fluid restrictor.

8. The liquid discharge head according to claim 6,
- wherein one of the plurality of recessed portions at the first surface of the single plate member is disposed between the individual liquid chamber and the fluid restrictor, and
- wherein another of the plurality of recessed portions at the second surface of the single plate member is disposed between the circulation channel and the circulation fluid restrictor.

9. A liquid discharge device comprising:
- the liquid discharge head according to claim 1, to discharge liquid.

10. The liquid discharge device according to claim 9, wherein the liquid discharge head is integrated as a single unit with at least one of:
- a head tank to store the liquid to be supplied to the liquid discharge head;
- a carriage mounting the liquid discharge head;
- a supply unit to supply the liquid to the liquid discharge head;
- a maintenance unit to maintain and recover the liquid discharge head; and
- a main scan moving unit to move the liquid discharge head in a main scanning direction.

11. A liquid discharge apparatus comprising:
- the liquid discharge device according to claim 9, to discharge the liquid.

12. A liquid discharge apparatus comprising:
- the liquid discharge head according to claim 1, to discharge the liquid.

13. The liquid discharge head according to claim 1, wherein the fluid resistance value of the fluid restrictor defined by configuration of the single plate member is different than the fluid resistance value of the circulation fluid restrictor which is also defined by the configuration of the single plate member.

14. A liquid discharge head comprising:
- a nozzle to discharge liquid;
- an individual liquid chamber communicated with the nozzle;
- a common liquid chamber to supply the liquid to the individual liquid chamber;
- a fluid restrictor disposed between the individual liquid chamber and the common liquid chamber;
- a circulation channel communicated with the individual liquid chamber;
- a circulation fluid restrictor disposed between the individual liquid chamber and the circulation channel; and a plurality of laminated plate members constituting the fluid restrictor, the individual liquid chamber, and the circulation fluid restrictor, wherein amongst the plurality of laminated plate members:

a first combination of one or more plate members configured to define the fluid restrictor includes a fluid restrictor plate member;

a second combination of one or more plate members configured to define the circulation fluid restrictor includes a circulation fluid restrictor plate member; and a single common plate member, other than the fluid restrictor plate member and the circulation fluid restrictor plate member, is disposed between the fluid restrictor plate member and the circulation fluid restrictor plate member, and wherein the single common plate member includes a plurality of recessed portions at a first surface of the single common plate member opposing the fluid restrictor and a second surface of the single common plate member opposing the circulation fluid restrictor, one of the plurality of recessed portions at the first surface of the single common plate member is disposed adjacent to the fluid restrictor, and another of the plurality of recessed portions at the second surface of the single common plate member is disposed adjacent to the circulation fluid restrictor.

15. The liquid discharge head according to claim 14, wherein the one of the plurality of recessed portions at the first surface of the single common plate member is disposed between the individual liquid chamber and the fluid restrictor, and wherein the another of the plurality of recessed portions at the second surface of the single common plate member is disposed between the circulation channel and the circulation fluid restrictor.

16. A liquid discharge device comprising:

the liquid discharge head according to claim 14, to discharge liquid.

17. The liquid discharge device according to claim 16, wherein the liquid discharge head is integrated as a single unit with at least one of:

a head tank to store the liquid to be supplied to the liquid discharge head;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

18. A liquid discharge apparatus comprising:

the liquid discharge device according to claim 16, to discharge the liquid.

19. A liquid discharge apparatus comprising:

the liquid discharge head according to claim 14, to discharge the liquid.

20. The liquid discharge head according to claim 14, wherein a length of said one of the plurality of recessed portions at the first surface of the single common plate member is different from a length of said another of the plurality of recessed portions at the second surface of the single common plate member.

* * * * *